US006957745B2

(12) United States Patent
Thibault et al.

(10) Patent No.: US 6,957,745 B2
(45) Date of Patent: Oct. 25, 2005

(54) TRANSFER SET

(75) Inventors: Jean-Claude Thibault, Saint Egreve (FR); Hubert Jansen, Jarrie (FR); Stephen Bint, Chippenham (GB)

(73) Assignee: Becton, Dickinson and Company, Franklin Lakes, NJ (US)

( * ) Notice: Subject to any disclaimer, the term of this patent is extended or adjusted under 35 U.S.C. 154(b) by 151 days.

(21) Appl. No.: 10/059,497

(22) Filed: Jan. 29, 2002

(65) Prior Publication Data

US 2002/0121496 A1 Sep. 5, 2002

Related U.S. Application Data

(63) Continuation-in-part of application No. 09/684,123, filed on Oct. 5, 2000, now Pat. No. 6,626,309, which is a continuation-in-part of application No. 09/420,979, filed on Oct. 20, 1999, now Pat. No. 6,378,714, which is a continuation-in-part of application No. 09/168,502, filed on Oct. 8, 1998, now Pat. No. 6,382,442.

(60) Provisional application No. 60/082,372, filed on Apr. 20, 1998.

(51) Int. Cl.[7] ..... B65D 39/00; B65D 41/10; B65D 47/04

(52) U.S. Cl. ..... 215/249; 141/330; 215/247; 215/355; 215/DIG. 3; 222/83; 604/411; 604/415

(58) Field of Search ..... 215/247, 258, 215/307, 355, DIG. 3, 249, 295–297, 308; 141/329, 2.21, 25.28, 330, 18; 604/403, 406, 411–416; 222/83, 81, 83.5

(56) References Cited

U.S. PATENT DOCUMENTS

| | | | |
|---|---|---|---|
| 37,221 | A | 12/1862 | Dunton |
| 659,519 | A | 10/1900 | De Oliveria |
| 2,342,215 | A | 2/1944 | Perelson |
| 2,388,634 | A | 11/1945 | De Woody |
| 2,524,365 | A | 10/1950 | Smith |

(Continued)

FOREIGN PATENT DOCUMENTS

| | | | |
|---|---|---|---|
| EP | 0 236 127 | A2 | 3/1987 |
| EP | 0 406 374 | B1 | 12/1989 |
| EP | 0 769 456 | A2 | 10/1996 |
| EP | 0 747 293 | A1 | 12/1996 |

(Continued)

OTHER PUBLICATIONS

German Patent No. DE 36 18 158 A1, May 30, 1986.
Swiss Patent No. 501 172, Dec. 31, 1970.
UK Patent Application No. 2 121 016 A, Jun. 1, 1983.
French Patent No. 950.625, Jul. 28, 1947.
French Patent No. 1.071.487, Feb. 26, 1953.
French Patent No. 1.328.635, Jul. 4, 1962.
French Patent No. 1.487.413, May 20, 1966.
French Patent No. 2.738.550, Sep. 9, 1995—translation attached.
French Patent No. 2.395.198, Jan. 19, 1979.

*Primary Examiner*—Stephen K. Cronin
*Assistant Examiner*—Niki M Eloshway
(74) *Attorney, Agent, or Firm*—David M. Fortunato; Howard & Howard Attorneys, PC

(57) ABSTRACT

A transfer set for transferring fluids from a first container, such as a conventional vial, to a second container, such as a conventional syringe. The transfer set includes an integral tubular housing having a tubular collar surrounding the rim of the vial, a radial portion sealingly engaging the stopper in the vial, an integral tubular transfer member and an outer tubular portion surrounding at least the distal portion of the tubular transfer member, a piercing member within the tubular transfer member and a closure releasably retaining the distal end of the piercing member.

23 Claims, 4 Drawing Sheets

U.S. PATENT DOCUMENTS

| | | | | |
|---|---|---|---|---|
| 2,607,503 | A | | 8/1952 | Sonnenberg |
| 2,653,609 | A | | 9/1953 | Smith |
| 2,659,370 | A | | 11/1953 | Smith |
| 2,667,986 | A | | 2/1954 | Perelson |
| 2,953,132 | A | | 3/1960 | Richter et al. |
| 3,033,202 | A | | 5/1962 | Richter et al. |
| 3,164,303 | A | | 1/1965 | Trautmann |
| 3,206,080 | A | | 9/1965 | Scislowicz |
| 3,278,063 | A | | 10/1966 | Kranzhoff |
| 3,356,093 | A | | 12/1967 | Monahon |
| 3,357,427 | A | | 12/1967 | Wittke et al. |
| 3,610,297 | A | | 10/1971 | Raaf et al. |
| 3,674,028 | A | | 7/1972 | Ogle |
| 3,779,371 | A | | 12/1973 | Rovinksi |
| 3,810,469 | A | | 5/1974 | Hurschman |
| 3,826,260 | A | | 7/1974 | Killinger |
| 3,838,689 | A | | 10/1974 | Cohen |
| 3,872,867 | A | * | 3/1975 | Killinger ..... 604/413 |
| 3,872,992 | A | | 3/1975 | Larson |
| 3,940,003 | A | | 2/1976 | Larson |
| 3,977,555 | A | | 8/1976 | Larson |
| 3,995,630 | A | | 12/1976 | Van De Veerdonk |
| 4,020,839 | A | | 5/1977 | Klapp |
| 4,048,999 | A | | 9/1977 | Kobel |
| 4,067,440 | A | | 1/1978 | Lataix |
| 4,153,057 | A | | 5/1979 | Kobel |
| 4,187,893 | A | | 2/1980 | Bujan |
| 4,210,255 | A | | 7/1980 | Pan |
| 4,296,786 | A | | 10/1981 | Brignola |
| 4,336,891 | A | | 6/1982 | Smith |
| 4,387,879 | A | | 6/1983 | Tauschinski |
| 4,412,623 | A | | 11/1983 | Schmidt |
| 4,418,827 | A | | 12/1983 | Butterfield |
| 4,425,120 | A | | 1/1984 | Sampson et al. |
| 4,460,735 | A | | 7/1984 | Froix |
| 4,493,348 | A | | 1/1985 | Lemmons |
| 4,505,709 | A | | 3/1985 | Froning et al. |
| 4,507,113 | A | | 3/1985 | Dunlap |
| 4,564,054 | A | | 1/1986 | Gustavsson |
| 4,573,506 | A | | 3/1986 | Paoletti |
| 4,573,976 | A | | 3/1986 | Sampson et al. |
| 4,576,211 | A | | 3/1986 | Valentini et al. |
| 4,588,403 | A | | 5/1986 | Weiss et al. |
| 4,619,651 | A | | 10/1986 | Kopfer et al. |
| 4,624,393 | A | | 11/1986 | Lopez |
| 4,639,250 | A | | 1/1987 | Rycroft |
| 4,662,878 | A | | 5/1987 | Lindmayer |
| 4,672,996 | A | | 6/1987 | Floyd et al. |
| 4,673,404 | A | | 6/1987 | Gustavsson |
| 4,675,020 | A | | 6/1987 | Mc Phee |
| 4,792,053 | A | | 12/1988 | Towne et al. |
| 4,822,351 | A | | 4/1989 | Purcell |
| 4,826,491 | A | | 5/1989 | Schramm |
| 4,834,149 | A | | 5/1989 | Fournier et al. |
| 4,834,152 | A | | 5/1989 | Howson et al. |
| 4,850,994 | A | | 7/1989 | Zerbet et al. |
| 4,884,703 | A | | 12/1989 | O'Meara |
| 4,909,290 | A | | 3/1990 | Coccia |
| 4,913,945 | A | | 4/1990 | Maruhashi et al. |
| 4,923,447 | A | | 5/1990 | Morgan |
| 4,927,423 | A | | 5/1990 | Malmborg |
| 4,932,937 | A | | 6/1990 | Gustavsson et al. |
| 4,982,740 | A | | 1/1991 | Broden |
| 5,006,118 | A | | 4/1991 | Yule |
| 5,024,256 | A | | 6/1991 | Vadjer |
| 5,035,689 | A | | 7/1991 | Schroeder |
| 5,060,812 | A | | 10/1991 | Ogle, II |
| 5,088,996 | A | | 2/1992 | Kopfer et al. |
| 5,092,840 | A | | 3/1992 | Healy |
| 5,116,326 | A | | 5/1992 | Schmidt |
| 5,169,385 | A | | 12/1992 | Turnball |
| 5,171,214 | A | | 12/1992 | Kolber et al. |
| 5,215,538 | A | | 6/1993 | Larkin |
| 5,217,433 | A | | 6/1993 | Bunin |
| 5,232,029 | A | | 8/1993 | Knox et al. |
| 5,232,109 | A | | 8/1993 | Tirrell et al. |
| 5,250,037 | A | | 10/1993 | Bitdinger |
| 5,275,299 | A | | 1/1994 | Konrad et al. |
| 5,279,576 | A | | 1/1994 | Loo et al. |
| 5,291,991 | A | | 3/1994 | Meyer |
| 5,297,599 | A | | 3/1994 | Bucheli |
| 5,342,319 | A | | 8/1994 | Watson et al. |
| 5,348,548 | A | | 9/1994 | Meyer et al. |
| 5,350,372 | A | | 9/1994 | Ikeda et al. |
| 5,352,196 | A | | 10/1994 | Haber et al. |
| 5,358,501 | A | | 10/1994 | Meyer |
| 5,360,413 | A | | 11/1994 | Leason et al. |
| 5,364,386 | A | | 11/1994 | Fukuoka et al. |
| 5,385,546 | A | | 1/1995 | Kriesel et al. |
| 5,397,303 | A | | 3/1995 | Sancoff et al. |
| 5,409,125 | A | | 4/1995 | Kimber et al. |
| 5,411,499 | A | | 5/1995 | Dudar et al. |
| 5,415,374 | A | | 5/1995 | Carroll et al. |
| 5,419,256 | A | | 5/1995 | Pollich |
| 5,421,814 | A | | 6/1995 | Geary |
| 5,423,791 | A | | 6/1995 | Bartlett |
| 5,425,465 | A | | 6/1995 | Healy |
| 5,429,256 | A | | 7/1995 | Kestenbaum |
| 5,433,330 | A | | 7/1995 | Yatsko et al. |
| 5,433,703 | A | | 7/1995 | Utterberg et al. |
| 5,435,282 | A | | 7/1995 | Haber et al. |
| 5,437,648 | A | | 8/1995 | Graves et al. |
| 5,441,487 | A | | 8/1995 | Vedder |
| 5,454,409 | A | | 10/1995 | Mc Affer et al. |
| 5,454,805 | A | | 10/1995 | Brony |
| 5,466,219 | A | | 11/1995 | Lynn et al. |
| 5,470,319 | A | | 11/1995 | Mayer |
| 5,470,327 | A | | 11/1995 | Helgren et al. |
| 5,474,541 | A | | 12/1995 | Ritsky et al. |
| 5,474,544 | A | | 12/1995 | Lynn |
| 5,487,737 | A | | 1/1996 | Meyer |
| 5,494,170 | A | | 2/1996 | Burns |
| 5,501,676 | A | | 3/1996 | Niedospial et al. |
| 5,514,116 | A | | 5/1996 | Vaillancourt et al. |
| 5,514,117 | A | | 5/1996 | Lynn |
| 5,520,641 | A | | 5/1996 | Behnke et al. |
| 5,520,642 | A | | 5/1996 | Bigagli et al. |
| 5,520,661 | A | | 5/1996 | Lal et al. |
| 5,520,665 | A | | 5/1996 | Fleetwood |
| 5,520,666 | A | | 5/1996 | Choudhury et al. |
| 5,533,983 | A | | 7/1996 | Haining |
| 5,533,994 | A | | 7/1996 | Meyer |
| 5,549,651 | A | | 8/1996 | Lynn |
| 5,566,729 | A | | 10/1996 | Grabenkort et al. |
| 5,573,516 | A | | 11/1996 | Tyner |
| 5,573,520 | A | | 11/1996 | Schwartz et al. |
| 5,573,525 | A | | 11/1996 | Watson et al. |
| 5,573,526 | A | | 11/1996 | Hess |
| 5,576,392 | A | | 11/1996 | Yamamoto et al. |
| 5,598,939 | A | | 2/1997 | Watson et al. |
| 5,613,291 | A | | 3/1997 | Solomon et al. |
| 5,616,129 | A | | 4/1997 | Mayer |
| 5,616,130 | A | | 4/1997 | Mayer |
| 5,620,434 | A | | 4/1997 | Brony |
| 5,641,010 | A | | 6/1997 | Maier |
| 5,662,230 | A | | 9/1997 | Finneran |
| 5,685,845 | A | | 11/1997 | Grimard |
| 5,697,915 | A | | 12/1997 | Lynn |
| 5,702,019 | A | | 12/1997 | Grimard |
| 5,709,666 | A | | 1/1998 | Reynolds |
| 5,718,348 | A | | 2/1998 | Manera |

| | | | | | |
|---|---|---|---|---|---|
| 5,776,124 | A | | 7/1998 | Wald | |
| 5,776,125 | A | | 7/1998 | Dudar et al. | |
| 5,785,701 | A | | 7/1998 | Sams et al. | |
| 5,803,284 | A | | 9/1998 | Grimard | |
| 5,819,964 | A | | 10/1998 | Grimard | |
| 5,833,089 | A | | 11/1998 | Manni et al. | |
| 5,855,575 | A | | 1/1999 | Solomon et al. | |
| 5,857,579 | A | | 1/1999 | Finneran | |
| 5,863,655 | A | | 1/1999 | Mock | |
| 5,873,872 | A | | 2/1999 | Thibault et al. | |
| 5,879,345 | A | | 3/1999 | Aneas | |
| 5,890,610 | A | * | 4/1999 | Jansen et al. | 215/253 |
| 5,891,129 | A | | 4/1999 | Daubert et al. | |
| 5,925,029 | A | | 7/1999 | Jansen et al. | |
| 5,931,828 | A | | 8/1999 | Durkee | |
| 5,954,104 | A | | 9/1999 | Daubert et al. | |
| 5,957,898 | A | | 9/1999 | Jepson et al. | |
| 6,003,566 | A | | 12/1999 | Thibault et al. | |
| 6,050,435 | A | | 4/2000 | Bush et al. | |
| 6,056,135 | A | | 5/2000 | Widman | |
| 6,070,623 | A | | 6/2000 | Aneas | |
| 6,071,270 | A | | 6/2000 | Fowles et al. | |
| 6,090,093 | A | * | 7/2000 | Thibault et al. | 604/415 |
| 6,113,583 | A | * | 9/2000 | Fowles et al. | 604/403 |
| 6,159,192 | A | | 12/2000 | Fowles et al. | |
| 6,189,580 | B1 | * | 2/2001 | Thibault et al. | 141/25 |
| 6,209,738 | B1 | * | 4/2001 | Jansen et al. | 215/247 |
| 6,213,994 | B1 | * | 4/2001 | Jansen et al. | 604/415 |
| 6,378,576 | B2 | * | 4/2002 | Thibault et al. | 141/329 |

FOREIGN PATENT DOCUMENTS

| | | |
|---|---|---|
| EP | 0 065 469 A2 | 5/1999 |
| FR | 1.328.635 | 7/1962 |
| WO | WO 84/04673 | 12/1984 |
| WO | WO 88/01881 | 3/1988 |
| WO | WO 92/11056 | 7/1992 |
| WO | WO 94/03373 | 3/1994 |
| WO | WO 95/00117 | 1/1995 |
| WO | WO 95/03841 | 2/1995 |
| WO | WO 95/14176 | 5/1995 |
| WO | WO 95/31242 | 11/1995 |
| WO | WO 95/33505 | 12/1995 |
| WO | WO 95/35125 | 12/1995 |
| WO | WO 96/13301 | 5/1996 |
| WO | WO 97/00702 | 1/1997 |
| WO | WO 97/10156 | 3/1997 |
| WO | WO 97/39720 | 10/1997 |
| WO | WO 98/13006 | 4/1998 |
| WO | WO 98/32411 | 7/1998 |
| WO | WO 98/37853 | 9/1998 |
| WO | WO 98/37854 | 9/1998 |
| WO | WO 99 43282 | 9/1999 |
| WO | WO 99 53886 | 10/1999 |
| WO | WO 01 28489 | 4/2001 |
| WO | WO 01 28490 | 4/2001 |
| WO | WO 01 32524 | 5/2001 |

* cited by examiner

TRANSFER SET

RELATED APPLICATIONS

This application is a continuation-in-part application of U.S. Ser. No. 09/684,123, filed Oct. 5, 2000 now U.S. Pat. No. 6, 626,309, which Application was a continuation-in-part of U.S. Ser. No. 09/420,979, filed Oct. 20, 1999 now U.S. Pat. No. 6,378,714, which Application was a continuation-in-part of U.S. Ser. No. 09/168,502, filed Oct. 8, 1998 now U.S. Pat. No. 6,382,442, claiming priority under 35 U.S.C. § 119(e) to U.S. Provisional Application Ser. No. 60/082,372, filed Apr. 20, 1998.

FIELD OF THE INVENTION

This invention relates to an improved transfer set for transferring fluid from a first container, such as a conventional vial having a pierceable closure or stopper, and a second container, such as a syringe.

BACKGROUND OF THE INVENTION

It is conventional to store drugs, vaccines, medicaments and solutions in a sealed vial or other container for later use. Drugs, vaccines, medicaments and solutions may be stored in a dry or powdered form to increase the shelf life and reduce inventory space. Such dry or powdered materials may be stored in a conventional sealed vial having a pierceable closure, such as an elastomeric stopper, and reconstituted in liquid form for later use, such as administration to a patient, by adding a diluent or solvent for example. Alternatively, such drugs, vaccines, medicaments and solutions may be stored in a vial in a liquid or even a gaseous form. A conventional vial for storing such materials in liquid, dry or gaseous form includes an open end, a radial rim portion surrounding the open end and a reduced diameter neck portion adjacent the rim portion. The vial is conventionally sealed with an elastomeric stopper or other pierceable closure which generally includes a tubular portion inserted in the open end in the neck of the vial and a planar rim portion which overlies the vial rim. The stopper is conventionally secured to the vial with a thin malleable metal cap, such as aluminum. Because aluminum is malleable, the collar accommodates the buildup of tolerances of the dimensions on the stopper and vial rim.

Recently, various vial transfer sets have been proposed for transferring fluid between a vial and a conventional syringe, wherein the transfer set is mounted on the vial for later use. The transfer set may include a piercing member, such as a needle cannula, generally telescopically mounted in a tubular fluid transfer member mounted on the open end of the vial. The transfer set may be enclosed by a cup-shaped closure or housing having a radial flange secured to the vial by a malleable metal or plastic collar.

Transfer sets have been utilized, for example, to transfer fluid from a vial to a syringe, such as a reconstituted dry or powdered drug, vaccine or medicament by adding a diluent or solvent in the syringe. The reconstituted drug may then be withdrawn from the vial by the syringe. The inner surface of the transfer set may be part of the fluid path and the aluminum collar or ring may bring aluminum particles into the sterile room where the drug, vaccine or medicament is added to the vial or into the drug path contaminating the drug, vaccine or medicament. There have been attempts to reduce this problem by applying a protective coating to the aluminum cap or collar. Finally, the prior art also includes snap-on cup-shaped plastic caps or collars having radially inwardly projecting end portion which is snapped over the rim of the vial. Snap-on collars, however, do not assure adequate sealing of the vial or fully accommodate the tolerances of standard vials and stoppers, as required.

The prior art also discloses plastic transfer sets for vials. However, such plastic transfer sets are relatively expensive having several interfitting parts and are difficult to manufacture and use. The need therefore remains for a transfer set for vials or other containers which may be utilized with conventional containers used by the medical industry, which assures sealing of the container and which achieves a good level of cleanliness, without particles or dust which may contaminate the drugs, vaccines or medicaments, the transfer set or the clean room, and which does not expose the health care worker to sharp metal edges. The need also remains for a transfer set which may be easily secured to a vial or other container and which is relatively simple in construction and easy to use.

SUMMARY OF THE INVENTION

The improved embodiments of the transfer set of this invention may be utilized, for example, to transfer fluid between a conventional vial having a pierceable closure or stopper and a conventional syringe having a Luer threaded connector without a needle cannula. However, the transfer set of this invention is universal in that it can be utilized to transfer fluid between any container having a pierceable closure and a second container. The components of the transfer set may be formed of polymers, preferably a polymer which may be sterilized for medical applications. In the most preferred embodiments of the transfer set of this invention, where the collar portion of the tubular housing member is radially deformed into the reduced diameter neck portion of the vial as described herein, the tubular housing member is preferably formed of a polymer which may be permanently deformed radially to secure the transfer set to the vial or container, yet sufficiently rigid to retain its shape following deformation and resistant to creep to maintain a good seal between the container and the transfer set, thereby avoiding contamination.

The embodiments of the improved transfer set of this invention include a tubular housing member having a proximal end adapted to be attached to the first container open end and an open distal end. For ease of description only, the term "proximal" is used herein to designate the portions of the transfer set closest to the first container or vial to which the transfer set may be attached and the term "distal" is used herein to refer to the portions or the components furthest from the first container. A cap is releasably attached over the open distal end of the tubular housing member, sealing the open distal end. The transfer set further includes a piercing member which is telescopically supported in the tubular housing member having a proximal piercing end adapted to pierce the closure in the open end of the container and a distal end. In the preferred embodiments of the transfer set of this invention, the housing includes an inner tubular portion and a spaced outer tubular portion adjacent the distal end. The inner tubular portion transfers fluid between the first and second containers and preferably includes a Luer thread to threadably receive the tip portion of a needleless syringe, for example, and the outer tubular portion receives a cap or closure which seals the assembly. In one preferred embodiment, the housing or body is generally "H" shaped in crosssection, wherein the inner tubular portion is integrally formed with the spaced outer tubular portion and the inner and outer tubular portions are integrally connected by an integral radial web portion. In this embodiment, the proximal end of the inner tubular portion sealingly engages the pierceable closure in the open end of the first container and the outer tubular portion includes a radial portion sealingly engaging the pierceable closure which is integrally formed with a tubular collar portion. The proximal end of the inner tubular portion includes a sharp end and the radial portion of the outer tubular portion may include one or a plurality of annular sealing rings. Fluid is thus transmitted between the first and second containers through the inner tubular portion.

In another preferred embodiment of the transfer set of this invention, the body is "Y" shaped or bell-shaped in cross-section including a central tubular portion and a spaced outer tubular arm portion surrounding the distal end portion of the inner tubular portion. The inner tubular portion thus transmits fluid between the first and second containers and preferably includes a Luer connector as described above, and the outer tubular portion receives a cap or closure as described. In this preferred embodiment, the proximal end of the inner tubular portion includes a radial portion which overlies the pierceable closure of the first container and preferably includes a plurality of spaced concentric annular sealing ribs or barbs which sealingly engage the pierceable closure and assure sealed communication between the first container and the inner tubular portion or tubular transfer portion. As described above, the radial portion is integrally formed with the tubular collar portion. The radial portion may also include radial ribs, preferably adjacent the intersection between the radial portion and the tubular collar portion, which prevent rotation of the body on the first container during threaded receipt of the second container as described above. In this preferred embodiment, the body portion is also preferably reinforced with radial web portions integral with the proximal portion of the inner tubular portion and both the radial portion and the outer tubular portion of the "Y" or bell-shaped distal end portion.

In the preferred embodiments of the transfer set disclosed in this application, the distal end of the piercing member is releasably retained to the cap, simplifying the assembly of the transfer set and assuring release of the piercing member following removal of the cap. The preferred embodiment of the cap includes a central portion overlying the distal open end of the inner tubular portion of the housing includes a connector portion which receives and releasably retains the distal end of the piercing member. In the preferred embodiment, the distal end of the piercing member includes a camming surfaces having a major diameter greater than the internal diameter of the tubular connector portion of the cap, providing an interference fit. In the disclosed embodiment, the camming surface on the free distal end of the piercing member is generally spherical or semi-spherical terminating in a relatively sharp edge which bites into the internal surface of the central tubular portion of the cap, thereby releasably retaining the piercing member to the cap. The preferred embodiment of the cap further includes an outer tubular portion which is received around the distal open end of the tubular housing member having a frangible connector portion adjacent the central portion, such as an annular groove. Thus, the central portion of the cap may be removed and the piercing member is retained by the cap until the central portion is removed.

The disclosed embodiment of the cap further includes an inner tubular portion concentric with an outer tubular portion surrounding the distal end portion of the outer tubular portion of the housing spaced from the outer tubular portion which is received within the open distal open end of the outer tubular portion of the housing member assuring a good seal of the open distal end of the tubular housing member. Further, in the disclosed embodiment, the outer surface of the tubular housing member adjacent the open distal end includes an annular radial rib which is received in an axial groove in the interior surface of the outer tubular portion of the cap preferably located adjacent to the frangible connector portion assuring receipt and retention of the cap on the outer tubular portion of the housing prior to use.

Where the improved transfer set of this invention is to be sealingly attached to a vial or other container having a rim portion surrounding the open end and a reduced diameter neck portion, the tubular housing or body preferably includes a tubular collar portion integral with the radial portion described above. The body portion may then be permanently attached to the rim portion of the vial or other container by radially deforming the open end of the collar portion into the reduced diameter neck portion of the container, preferably by incrementally rolling the open end of the collar portion into the neck portion as described in the copending application Ser. No. 09/732,538, filed Dec. 8, 2000 assigned to the assignee of this application, the disclosure of which is incorporated herein by reference.

The embodiments of the transfer set of this invention may then be assembled, as follows. The piercing member may be assembled to the cap or closure by inserting the distal end of the piercing member into the annular central retaining portion of the cap, releasably retaining the piercing member to the cap. The cap may then be assembled on the open distal end of the outer tubular portion of the housing by inserting the outer tubular portion of the housing between the concentric annular tubular portions of the cap, or vice versa. The external annular rib adjacent the distal end of the outer tubular portion of the housing and internal ribs retain the cap on the housing and hermetically seal the assembly. In the preferred embodiment, the housing, cap and piercing member are formed of a sterilizable polymer as described below. The transfer set may then be permanently secured to the rim portion of a vial or other container as described above, such as the manufacture of the drug, vaccine, medicament or solution under aseptic conditions.

The transfer set of this invention may then be used to transfer fluid between the first container to which it is attached and a second container through the inner tubular transfer member. In a typical application wherein the first container, such as a vial, contains a drug, vaccine, medicament or solution in dry or liquid form, the cover or cap is removed by breaking the frangible connection between the central portion of the cap and the outer tubular portion, exposing the Luer connection on the outer surface of the inner tubular transfer member adjacent the open distal end. The second container, such as a syringe without a needle cannula having a female Luer connection, is then threadably attached to the Luer connection adjacent the distal end of the tubular transfer member. The tubular tip portion of the syringe is thereby received within the inner tubular transfer member, driving the piercing member to pierce the pierceable closure, such as a conventional elastomeric stopper, providing fluid communication between the first container and the second container. In the preferred embodiment of the transfer set, wherein the piercing member is releasably attached to the cap as described above, the removal of the central portion of the cap releases the piercing member and the tubular tip portion of the syringe is then received against the piercing member distal end during threaded attachment as described above.

Other advantages and meritorious features of the improved transfer set of this invention will be more fully understood from the following description of the preferred of embodiments, the appended claims and the drawings, a brief description of which follows.

DESCRIPTION OF THE PREFERRED EMBODIMENTS

Figure 1:
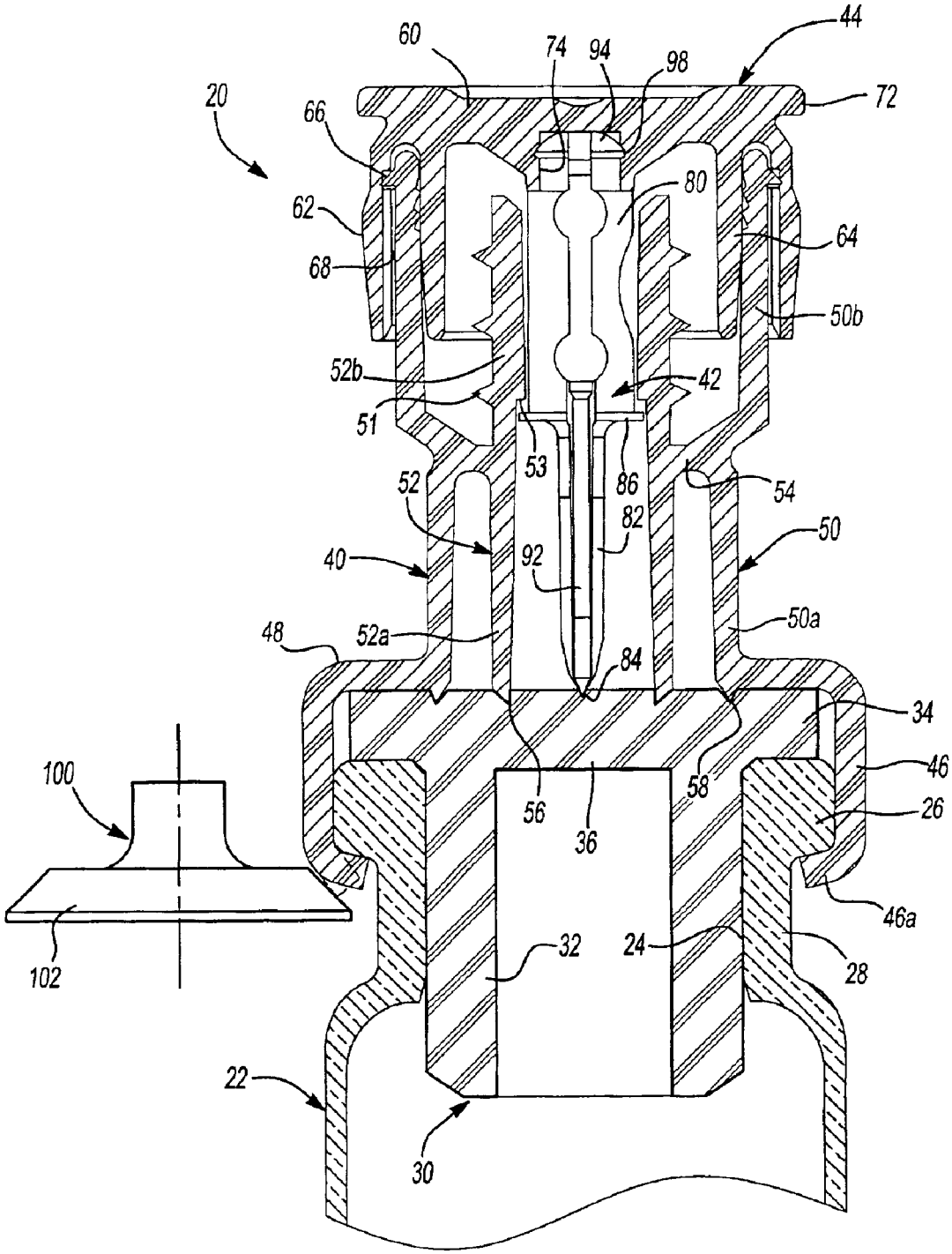
FIG. 1 is a side, partially crosssectioned view of one preferred embodiment of the transfer set of this invention also illustrating the attachment of the transfer set on a conventional vial.

FIG. 1 illustrates one preferred embodiment of the transfer set 20 of this invention attached to a conventional vial 22. As set forth above, the preferred embodiments of the transfer set of this invention are universal in that they can be utilized to transfer fluids from any container to a second container. However, one advantage of the transfer set of this invention is that it can be utilized to transfer fluids between a conventional vial, such as shown at 22, and a conventional syringe (not shown) without a needle cannula having a tubular tip portion with an internal Luer connector. The vial 22 illustrated in FIG. 1 includes an opening 24, a radial rim portion 26 surrounding the open end and a reduced diameter neck portion 28 adjacent the rim portion 26. The vial is conventionally formed of glass, but may also be formed of plastic. The opening 24 in the vial 22 is conventionally sealed with an elastomeric stopper 30 which generally includes a tubular or cylindrical portion 32 having an external diameter slightly greater than the internal diameter of the opening 24 to provide a tight seal and a rim portion 34 overlying the rim portion 26 of the vial 22. As will be understood by those skilled in this art, the stopper or pierceable closure 30 may take various forms and includes a central portion 36 which may be pierced by a piercing member or needle cannula to transfer fluids between the vial 22 and a second container, such as a conventional syringe.

The transfer set 20 of this invention includes three components, namely a generally tubular body or housing 40, which is affixed to the rim portion 26 of the vial 22 in sealed relation, a piercing member 42, which is adapted to pierce the central portion 36 of the stopper 30, and a cap or closure 44, which seals the open end of the transfer set 20. One advantage of the embodiments of the transfer set of this invention is the simplicity of the design. Each of the components may be formed of a sterilizable polymer and are preferably formed of a clear polymer permitting visualization of the operation and transfer of fluid between the vial 22 and a second container (not shown).

The generally tubular body 40 includes a tubular collar portion 46, which may be permanently affixed to the rim portion 26 of the vial 22 as described below, a radial portion 48 which overlies and sealingly engages the rim portion 34 of the stopper 30 and a generally "H" shaped in crosssection spaced integral outer and inner tubular portions 50 and 52, respectively, which are coaxially aligned with the opening 24 of the vial 22. The outer tubular portion 50 includes a proximal tubular portion 50*a* and a distal tubular portion 50*b* and the inner tubular portion 52 includes a proximal tubular portion 52*a* and a distal tubular portion 52*b*. The outer tubular portion 50 is integrally joined with the inner tubular portion 52 by a radial web portion 54. As will be understood, the generally tubular body 40 may thus be integrally formed by conventional molding techniques, including injection molding. Because the transfer set 20 is adapted to transfer fluid between the vial 22 and a second container (not shown) through the inner tubular portion 52, the inner and outer tubular portions 52 and 50, respectively, are preferably sealingly supported on the stopper 30. In this embodiment of the transfer set 20, the proximal portion 52*a* of the inner tubular portion 52 includes an annular sharp edge 56 preferably coincident with the internal surface of the proximal inner tubular portion 52*a* sealing the communication between the vial 22 and the inner tubular transfer member 52. The proximal portion 50*a* of the outer tubular portion 50 also includes an annular rib 58 preferably having a sharp circular edge which provides a redundant seal and prevents entry of foreign matter into the tubular transfer member 20. The radial portion 48 of the body 40 may additionally include a concentric sealing rib (not shown) surrounding the sealing rib 58, providing redundant sealing.

Figure 2:
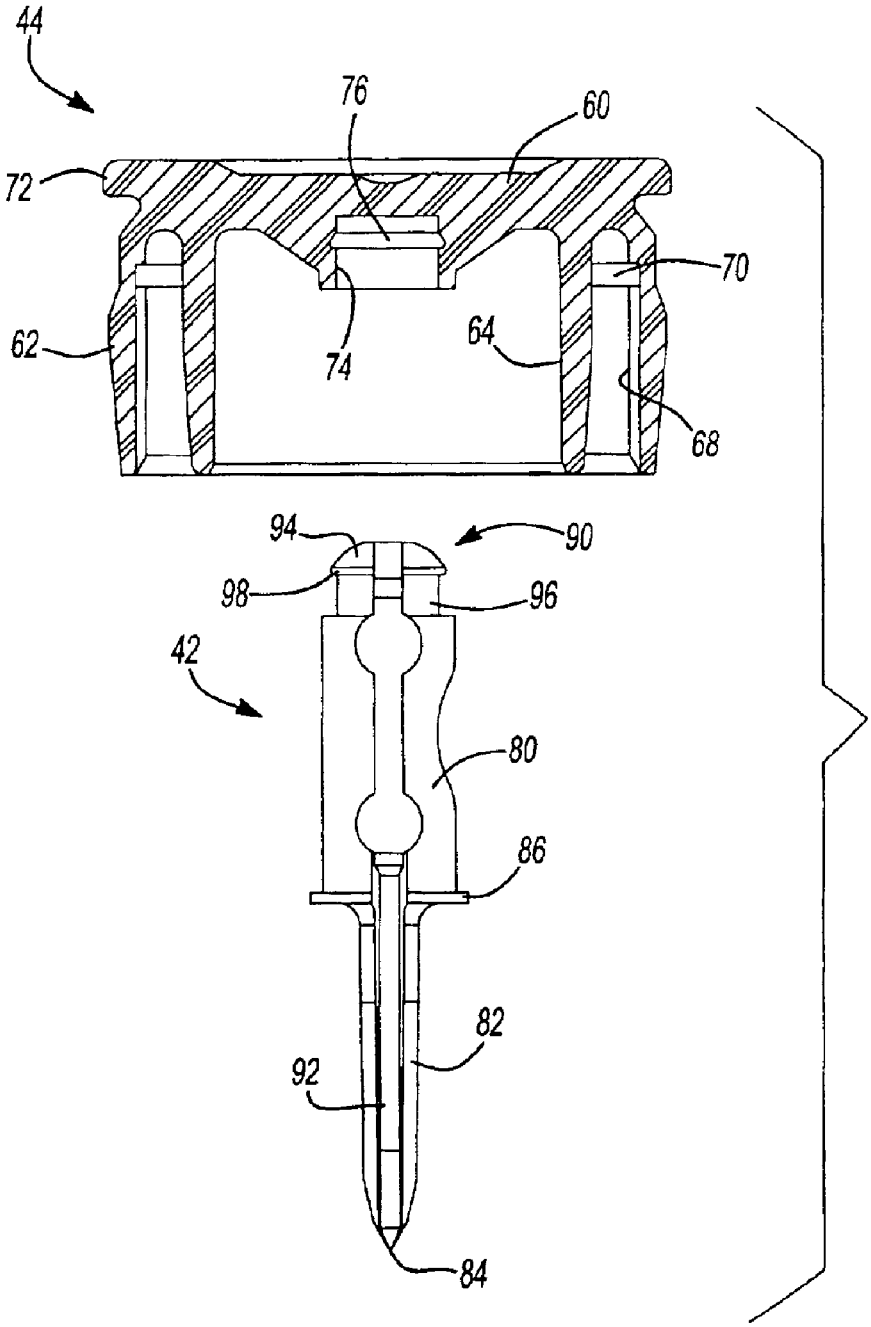
FIG. 2 is an exploded side view of a preferred embodiment of the piercing member and cap, wherein the cap is crosssectioned, illustrating assembly of the piercing member to the cap.

The cap or closure 44 is generally cup-shaped, including a generally planer central portion 60 which overlies the distal outer tubular portion 50*b* as shown in FIG. 1, an outer tubular rim portion 62 which surrounds the distal end portion 50*b* of the outer tubular portion 50 and a concentric inner tubular rim portion 64. The distal end portion 50*b* is received between the concentric outer and inner rim portions 62 and 64 of the cap as shown in FIG. 1 and the distal tubular end portion 50*b* includes an annular radial rib 66 adjacent its distal end which is received in an axial slot 68 in the outer radial rim portions 62 best shown in FIG. 2. The radial groove 70 (shown in FIG. 2) in the outer tubular rim portion 62 receives the radial annular rib 66 of the distal end portion 50*b* and weakens the wall of the outer tubular rim portion 62 providing a frangible connection between the central portion 60 of the cap and the outer tubular rim portion 62 which breaks during removal of the cap as described below. The generally planer central portion 60 also includes a radial annular lip portion 72 which may be gripped by the user during removal of the cap 44. The generally planer central portion 60 also includes a generally cylindrical recess 74 as shown in FIG. 2 which optionally include a counter bore, such as a frustoconical counter bore 76 which receives and releasably retains the distal end of the piercing member 42 as described below. Alternative, the bore 74 may be cylindrical without a counter bore and the piercing member 42 is formed of a polymer which is harder than the cap 44, such that the edge 98 bites into the softer cap releasably retaining the piercing member 42 in the cap 44.

The piercing member 42 in the disclosed embodiment includes a body portion 80, a reduced diameter piercing portion 82 having a relatively sharp piercing end 84, a radial flange portion 86 between the body portion 80 and the piercing portion 82 and a head portion 90. A longitudinal channel 92 extends from the piercing end 84 through the radial flange 86 into the body portion 80 as shown in FIGS. 1 and 2. The head portion 90 at the distal end of the piercing member 42 includes a generally hemispherical distal end portion 94, a reduced diameter portion 96 and a frustoconical surface 98 between the distal end portion 94 and the reduced diameter portion 96 as best shown in FIG. 2. Prior to assembly of the cap 44 on the distal end portion 50*b* of the body 40, the generally hemispherical distal end portion 94 of the piercing member 42 is inserted into the generally cylindrical recess 74 in the end portion 60 of the cap 44. In the preferred embodiment, the generally hemispherical distal end portion 94 of the piercing member 42 has a major diameter slightly greater than the internal diameter of the cylindrical recess 74 providing an interference fit until the outer peripheral surface of the generally hemispherical head 94 is received in the frustoconical counter bore 76, wherein the frustoconical surface 98 of the piercing member is received in the frustoconical counter bore 76. Alternatively, the cylindrical recess or bore 74 may be smooth and the cap 44 is formed of a softer polymer than the piercing member 42, such that the sharp edge 98 bites into the cylindrical recess 74. The piercing member 42 is thus releasably retained in the cap 44 during assembly of the cap on the body 40.

Because the diameter of the radial flange portion 86 of the piercing member 42 is greater than the internal diameter of the inner tubular portion 52*b* distally of the abutment surface 53 to prevent removal of the piercing member 42 during removal of the cap 44 as shown in FIG. 1, the distal end of the piercing member 42 is first inserted into the proximal open end 52*a* of the inner tubular portion 52 and the cap 44 is then secured on the distal open end 50*b* of the outer tubular portion between the outer and inner tubular rim portions 62 and 64, respectively, of the cap, wherein the annular rib 66 is received in the axial slot 68 until the rib 66 is received in the transverse radial slot 70 shown in FIG. 2. During assembly of the cap 44 on the distal open end 50*b* of the outer tubular portion 50, the piercing member 42 is retained by any suitable means, including a fixture, and the generally hemispherical distal end portion 94 is then simultaneously received in the generally cylindrical recess 74 of the cap, releasably retaining the piercing member 42 in the cap until removal of the cap by the healthcare worker or patient as described below. The transfer set 20 is now ready for securement to a vial 22 or other suitable container.

As will be understood by those skilled in this art, the transfer set 20 of this invention may be assembled at one facility, such as the manufacturer of the transfer set under aseptic conditions, packaged in a sterile container and supplied to a drug manufacturer, for example. After filling the vial 22 with a suitable drug, vaccine, medicament or solution, the drug manufacturer may then permanently attach the transfer set 20 on the vial 22 as now briefly described. First, the tubular collar portion 46 is received around the rim portion 26 of the vial 22 and the transfer set 20 is then compressed against the rim portion 34 of the stopper 30, which drives the sharp edge 56 of the proximal end 52*a* of the inner tubular portion 52 and the annular rib 58 on the proximal portion 50*a* of the outer tubular portion 50 into the rim portion 34 of the stopper 30, sealing the transfer set to the stopper 30. The free open end 46*a* of the collar portion 46 is then deformed radially into the reduced diameter neck portion 28 of the vial 22 beneath the rim portion 26 of the vial, preferably with a roller 100 having a frustoconical surface 102 which incrementally rolls the free open end 46*a* of the tubular collar portion 46 into the reduced diameter neck portion 28 to avoid cracking. Alternatively, as described in the above-referenced copending U.S. application Ser. No. 09/732,538 assigned to the assignee of this application, the transfer set 20 and vial assembly may be rolled against a frustoconical surface, permanently attaching the transfer set to the vial 22 or other container.

Having described a preferred embodiment of the transfer set 20 and the method of assembly, the use of the transfer set by a healthcare worker or patient can now be described as follows. First, the cap 44 is removed by lifting the annular lip 72 with the fingers. The piercing member 42 is then released from the cap 44, wherein the flange 86 engages the abutment surface 53 on the interior surface of the inner tubular portion 52. The transfer set may then be used to either withdraw fluid from the vial 22 or to add fluid to the vial to reconstitute a dry or lyophilized drug, vaccine or medicament in the vial 22 for example. In the preferred embodiment, the distal portion 52*b* of the inner tubular member 52 includes a Luer connector 51 to receive the Luer connector of the second container (not shown), such as the tip portion of a conventional syringe without a needle cannula. As the tip portion of the syringe is threadably received on the Luer connector 51, the tip portion engages the distal end 94 of the piercing member and drives the piercing member through the central portion 36 of the stopper 30, establishing fluid communication through the central portion 36 through the channel 92 of the piercing member 42. Fluid, such as a diluent or solvent, may then be added to the vial to reconstitute a powder or lyophilized medicament, drug or vaccine, or fluid may be removed from the vial using the plunger of the syringe (not shown).

Figure 6:
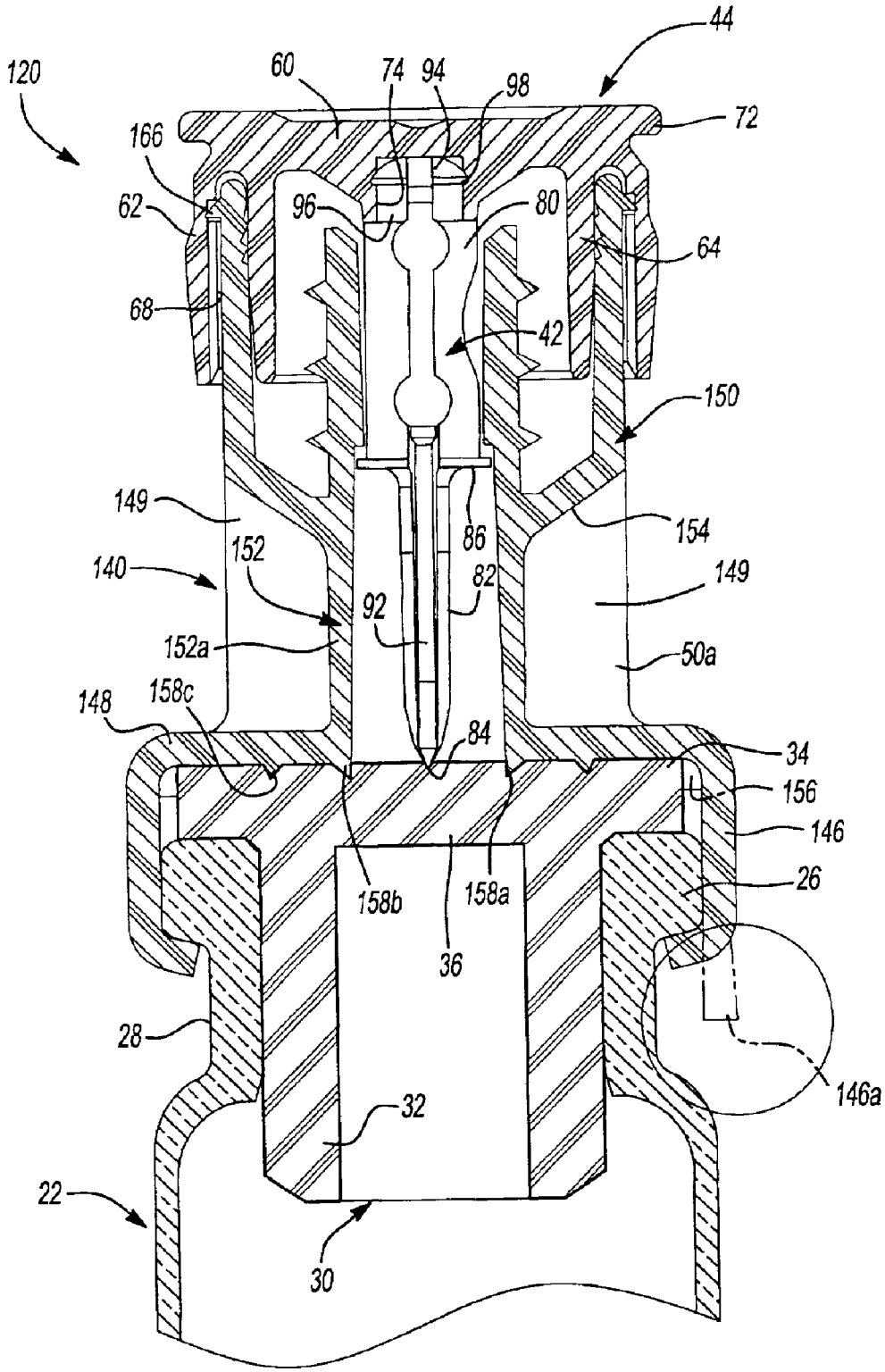
FIG. 6 is a side partially crosssectioned view of a transfer set of this invention with the housing or body illustrated in FIGS. 3 to 5.

FIG. 6 illustrates an alternative embodiment of the transfer set 120 of this invention, wherein the elements of the body 140 are numbered in the same sequence as the body 20 illustrated in FIG. 1. The piercing member 42 and cap 44 in the embodiment of the transfer set 120 shown in FIG. 6 are identical to the piercing member and cap illustrated in FIGS. 1 and 2 and therefore no further description of these components is necessary for a complete understanding of the embodiment of the transfer set 120.

Figure 3:
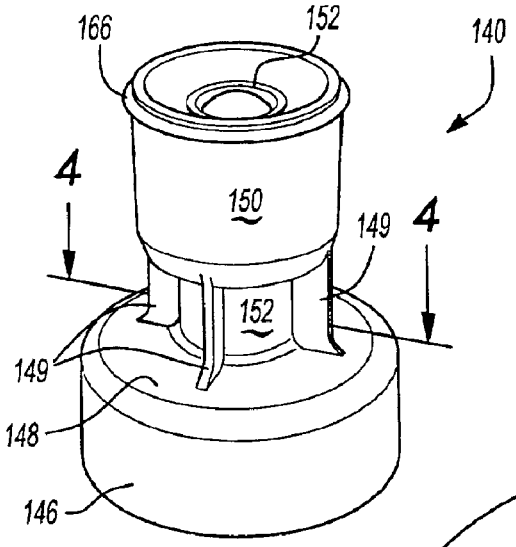
FIG. 3 is a side elevation of an alternative embodiment of the body or housing of the transfer set of this invention.
Figure 4:
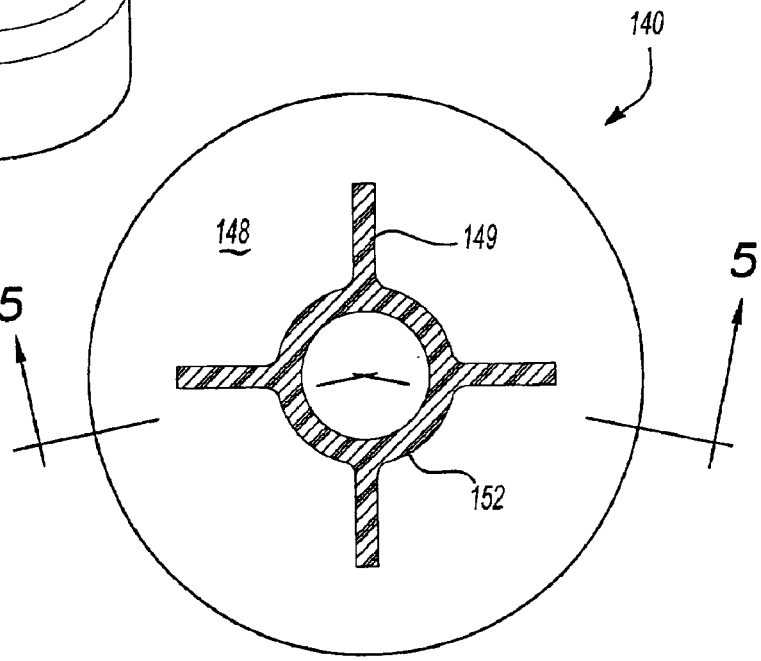
FIG. 4 is a top view of the embodiment of the housing shown in FIG. 3, with the top or distal end of the body crosssectioned for clarity in the direction of view arrows 4—4 in FIG. 3.
Figure 5:
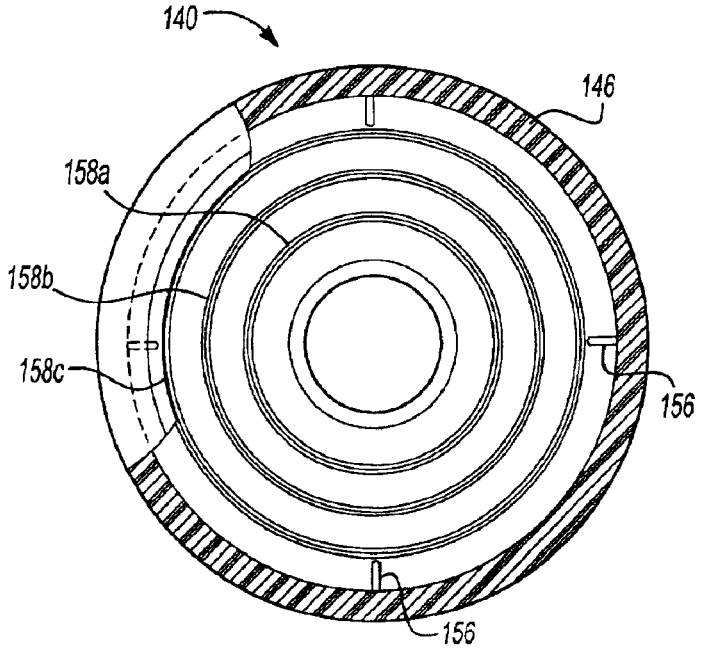
FIG. 5 is a bottom partially crosssectioned view of the body shown in FIG. 4, in the direction of view arrows 5—5.

The generally tubular body or housing 140 shown in more detail in FIGS. 3 to 5, may be characterized as generally "Y", bell-shaped or funnel-shaped. As described above, the generally tubular body 140 may be integrally molded by conventional techniques, including injection molding. The tubular body 140 illustrated in FIGS. 3 to 6 includes an outer tubular portion 150 which extends from an intermediate portion of the inner tubular portion 152 and is integrally joined to the inner tubular portion 152 by a generally radial inclined portion 154 as shown in FIG. 6. Thus, as discussed further below, the proximal portion 50*a* of the outer tubular portion has been eliminated in this embodiment. The radial portion 148 in this embodiment is formed integrally with the proximal portion 152*a* of the inner tubular member 152 as shown in FIG. 6. In the preferred embodiment, the tubular body 140 further includes a plurality of integral radial web portions 149 which are formed integrally with the proximal portion 152*a* of the inner tubular portion 152, the radial portion 148 and the inclined portion 154, as best shown in FIGS. 3 and 4. These radial web portions 149 strengthen the tubular body 140 for applications requiring greater strength, as described below. The radial portion 148 also includes a plurality of preferably concentric circular barbs 158*a*, 158*b* and 158*c* which extend perpendicular to the radial portion 148 each having a sharp edge which bites into and sealingly engages the rim portion 34 of the stopper as shown in FIGS. 5 and 6. The concentric barbs assure sealing of the transfer set 120 on the stopper 30 both from external contamination and the fluid transferred through the inner tubular portion 152 of the body. In the preferred embodiment, the body 140 also includes a plurality of circumferentially spaced radial ribs 156 which, in the disclosed embodiment, are integral with the radial portion 148 and the tubular collar portion 146. The radial ribs 156 prevent rotation of the transfer set 120 on the vial 22, particularly during threaded receipt of the syringe. Except as described above, the remaining elements of the generally tubular body 140 are identical to the tubular body 40 described above and such elements have been numbered in the same sequence as the body 40, except in the 100 series. No further explanation of the generally tubular body 140 is therefore required. Further, the transfer set 120 may be assembled and fixed to the vial 22 as described above. Therefore, no further explanation of the embodiment of the transfer set 120 is required.

The embodiment of the transfer set 20 shown in FIG. 1 is preferred in applications where the diameter of the vial rim is 13 mm and the transfer set 120 shown in FIG. 6 is preferred where the vial rim diameter is 20 mm. The preference for the embodiment 120 for larger vials is based upon the improved sealing provided by the concentric barbs 158*a*, 158*b* and 158*c* and the elimination of the chamber between the proximate portions 50*a* and 52*b* of the outer and inner tubular portions 50 and 52 for larger vials.

As will be understood by those skilled in this art, various modifications may be made to the disclosed preferred embodiments of the transfer set of this invention within the purview of the appended claims. For example, various piercing members may be utilized with the transfer set of this invention, including but not limited to a piercing member having an axial bore. The number of barbs on the radial portion which bite into the rim portion 34 of the stopper will also depend upon the sealing requirements and the size of the vial as will be understood from the above description. Other cap designs may also be utilized with the tubular body including, for example, peel-off closures as disclosed in the above-referenced copending patent applications. Finally, although the components of the transfer set of this invention may be formed of various polymers, the tubular body 40, 140 is preferably formed of a polymer which is sufficiently malleable to permit radial deformation of the tubular collar into the neck 28 of the vial 22, yet sufficiently rigid to retain its shape following deformation and resistant to creep to maintain a good seal between the collar portion of the transfer set and the vial and the polymer selected for the tubular body is preferably clear or transparent. As described more fully in the above-referenced copending application Ser. No. 09/684,123, such polymers include melt blends, alloys and copolymers of polycarbonate or polyamid and polyester. Having described the preferred embodiments of the transfer set of this invention, the invention is now claimed as follows.

What is claimed is:

1. A transfer set for transferring fluids between a first container including an open end, a rim portion surrounding said open end and a pierceable closure in said open end sealing said first container, and a second container, said transfer set comprising:

an integral body, formed as one piece, including a first tubular portion surrounding said rim portion of said first container having an open end permanently deformed radially beneath said rim portion of said first container so as to permanently attach said transfer set to said first container, a radial portion integral with said first tubular portion overlying said rim portion of said first container, a second tubular portion integral with said radial portion having an open proximal end overlying said pierceable closure generally coaxially aligned with said open end of said first container and a distal open end adapted to receive said second container, and a third tubular portion integrally joined to said second tubular portion having a distal open end surrounding said distal open end of said second tubular portion in spaced relation;

a piercing element telescopically received in said second tubular portion having a piercing end adjacent said pierceable closure and moveable within said second tubular portion to pierce said pierceable closure and establish fluid communication between said first and second containers through said second tubular portion; and a removable closure overlying and sealing said distal open end portion of said third tubular portion.

2. The transfer set as defined in claim 1, wherein said third tubular portion is joined to said second tubular portion by a generally radial bridging portion integrally joined to a midportion of said second tubular portion.

3. The transfer set as defined in claim 2, wherein said distal open end portion of said third tubular portion is generally concentric with and spaced from said distal open end of said second tubular portion.

4. The transfer set as defined in claim 1, wherein said distal open end of said second tubular portion includes a Luer connection adapted to threadably receive a Luer connection of said second container.

5. The transfer set as defined in claim 1, wherein said radial portion of said integral body overlies said pierceable closure and said radial portion including a plurality of generally concentric ribs surrounding said second tubular portion sealingly engaging said pierceable closure.

6. The transfer set as defined in claim 5, wherein said concentric ribs are circular and coaxially aligned with said second tubular portion.

7. The transfer set as defined in claim 5, wherein said concentric ribs have a sharp circular edge biting into said pierceable closure.

8. The transfer set as defined in claim 5, wherein said radial portion includes radial ribs adjacent said first tubular portion engaging said pierceable closure and preventing rotation of said transfer set relative to said first container.

9. The transfer set as defined in claim 1, wherein said piercing element includes an elongated body portion releasably contained in said second tubular portion of said body by said closure.

10. The transfer set as defined in claim 9, wherein said second tubular portion includes an internal abutment surface and said body portion of said piercing element includes a radial portion preventing withdrawal of said piercing element from said second tubular portion.

11. The transfer set as defined in claim 1, wherein said open proximal end of said second tubular portion includes an axially extending barb surrounding said open proximal end sealingly engaging said pierceable closure and providing sealed communication between said first container and said second tubular portion.

12. The transfer set as defined in claim 1, wherein said second tubular portion of said body is generally cylindrical and said third tubular portion is bell-shaped having a rim portion surrounding said distal open end of said second tubular portion and a proximal end portion extending generally radially inwardly and integrally joined to a midportion of said second tubular portion.

13. A transfer set for transferring fluids between a first container including an open end, a rim portion surrounding said open end and a pierceable closure in said open end sealing said first container and a second container, said transfer set comprising:

an integral body, formed as one piece, including a first generally cylindrical tubular portion surrounding said rim portion of said first container having an open distal end and a proximal end portion, said open distal end being permanently deformed radially beneath said rim portion of said first container so as to permanently attach said transfer set to said first container, a radial portion integral with a proximal end of said first tubular portion extending radially inwardly and overlying said pierceable closure, a second generally cylindrical tubular portion integral with a radial inner extent of said radial portion extending generally perpendicular to said radial portion having an open proximal end overlying said pierceable closure generally coaxially aligned with said open end of said first container and a distal open end adapted to receive said second container, said radial portion including a plurality of generally concentric ribs surrounding said open proximal end of said second tubular portion sealingly engaging said pierceable closure, and a third tubular portion having an open distal end surrounding said distal open end of said second tubular portion and a proximal end portion integrally joined to said second tubular portion spaced from said radial portion;

a piercing element telescopically received in said second tubular portion having a piercing end opposite said pierceable closure and moveable within said second tubular portion to pierce said pierceable closure and establish fluid communication between said first and second containers through said second tubular portion; and a removable closure overlying and sealing said distal open end portion of said third tubular portion.

14. The transfer set as defined in claim 13, wherein said proximal end portion of said third tubular portion is joined to said second tubular portion by a radial bridging portion integrally joined to a midportion of said second tubular portion.

15. The transfer set as defined in claim 14, wherein said third tubular portion is bell-shaped having a rim portion surrounding said distal open end of said second tubular portion in spaced relation and a generally radially inwardly extending portion integrally joined to said midportion of said second tubular portion.

16. The transfer set as defined in claim 13, wherein said distal open end of said second tubular portion includes a Luer connector adapted to threadably receive a threaded end portion of said second container.

17. The transfer set as defined in claim 13, wherein said plurality of generally concentric ribs are circular and coaxially aligned with said second tubular portion.

18. The transfer set as defined in claim 13, wherein said plurality of generally concentric ribs each have a sharp circular edge biting into said pierceable closure.

19. The transfer set as defined in claim 13, wherein said radial portion includes radial ribs adjacent said first tubular portion sealingly engaging said pierceable closure.

20. The transfer set is defined in claim 13, wherein said piercing element includes an elongated body portion having a distal end releasably retained in said second tubular portion by said removable closure.

21. The transfer set as defined in claim 13, wherein said open proximal end of said second tubular portion includes an axially extending barb sealingly engaging said pierceable closure and providing sealed communication between said first container and said second tubular portion.

22. A transfer set for transferring fluids between a first container including an open end, a rim portion surrounding said open end and a pierceable closure in said open end sealing said first container, and a second container, said transfer set comprising:

an integral body including a first tubular portion surrounding said rim portion of said first container have an open end secured to said rim portion of said first container, a radial portion integral with said first tubular portion overlying said rim portion of said first container, a second tubular portion integral with said radial portion having an open proximal end overlying said pierceable closure generally coaxially aligned with said open end of said first container and a distal open end adapted to receive said second container, and a third tubular portion integrally joined to a midportion of said second tubular portion by a generally radial bridging portion, said third tubular portion having a distal open end surrounding said distal open end of said second tubular portion in spaced relation;

a piercing element telescopically received in said second tubular portion having a piercing end adjacent said pierceable closure and moveable within said second tubular portion to pierce said pierceable closure and establish fluid communication between said first and second containers through said second tubular portion; and a removable closure overlying and sealing said distal open end portion of said third tubular portion.

23. A transfer set for transferring fluids between a first container including an open end, a rim portion surrounding said open end and a pierceable closure in said open end sealing said first container and a second container, said transfer set comprising:

an integral body including a first generally cylindrical tubular portion surrounding said rim portion of said first container having an open distal end secured to said rim portion of said first container and a proximal end portion, a radial portion integral with a proximal end of said first tubular portion extending radially inwardly and overlying said pierceable closure, a second generally cylindrical tubular portion integral with a radial inner extent of said radial portion extending generally perpendicular to said radial portion having an open proximal end overlying said pierceable closure generally coaxially aligned with said open end of said first container and a distal open end adapted to receive said second container, said radial portion including a plurality of generally concentric ribs surrounding said open proximal end of said second tubular portion sealingly engaging said pierceable closure, and a third tubular portion having an open distal end surrounding said distal open end of said second tubular portion and a proximal end portion integrally joined to a midportion of said second tubular portion by a radial bridging portion;

a piercing element telescopically received in said second tubular portion having a piercing end opposite said pierceable closure and moveable within said second tubular portion to pierce said pierceable closure and establish fluid communication between said first and second containers through said second tubular portion; and a removable closure overlying and sealing said distal open end portion of said third tubular portion.

* * * * *